US006675407B1

(12) United States Patent
Ball

(10) Patent No.: US 6,675,407 B1
(45) Date of Patent: Jan. 13, 2004

(54) SOLENOID ACTIVATED BATHTUB DRAIN CLOSURE

(75) Inventor: William T. Ball, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 0 days.

(21) Appl. No.: 10/291,085

(22) Filed: Nov. 8, 2002

(51) Int. Cl.[7] ..... E03C 1/23
(52) U.S. Cl. ..... 4/691; 4/688
(58) Field of Search ..... 4/286, 295, 679, 4/688, 689, 690, 691, 692

(56) References Cited

U.S. PATENT DOCUMENTS 775,018 A * 11/1904 Waterman ..... 4/689 X
6,148,454 A 11/2000 Ball

FOREIGN PATENT DOCUMENTS

EP 487215 * 5/1992 ..... 4/691
FR 2422375 * 12/1979 ..... 4/688

* cited by examiner

*Primary Examiner*—Robert M. Fetsuga

(57) ABSTRACT

A solenoid activated bathtub drain closure is associated with the bathtub having a bottom with a drain opening therein. A vertically movable drain stopper is mounted over the drain opening. A drain pipe is connected to the drain opening and is conventionally positioned below the drain opening. A solenoid having a movable plunger is located outside the drain pipe and is preferably mounted on the drain pipe. Linkage is secured to the plunger and extends from the plunger into the drain pipe and terminates at an inner end underneath the drain opening. The linkage is so configured that when the plunger is moved by the solenoid from a first position to a second position, the inner end of the linkage will engage the stopper and raise it with respect to the drain opening to permit fluid in the bathtub to flow by gravity.

4 Claims, 3 Drawing Sheets

SOLENOID ACTIVATED BATHTUB DRAIN CLOSURE

BACKGROUND OF THE INVENTION

Drain closures in bathtubs assume a variety of designs, but normally include a stopper element that is manually moved upwardly and downwardly to assume open and closed positions, respectively. The manual movement of the drain closure means is sometimes an inconvenience to elderly people or those with some physical infirmity.

Solenoid activated valves and the like are common in a number of environments, but they have not been successfully adapted to the drain closures of bathtubs.

It is therefore a principal object of this invention to provide a solenoid actuated bathtub drain closure.

A further object of this invention is to provide a solenoid activated bathtub drain closure which can be easily and quickly installed in the bathtub environment to facilitate the opening and closing of a bathtub drain closure.

A still further object of this invention is to provide a solenoid activated bath drain closure which is simple in construction, economical to build and install, and trouble free in its operation.

These and other objects will be apparent to those skilled in the art.

SUMMARY OF THE INVENTION

A solenoid activated bathtub drain closure is associated with the bathtub having a bottom with a drain opening therein. A vertically movable drain stopper is mounted over the drain opening. A drain pipe is connected to the drain opening and is conventionally positioned below the drain opening.

A solenoid having a movable plunger is located outside the drain pipe and is preferably mounted on the drain pipe.

Linkage is secured to the plunger and extends from the plunger into the drain pipe and terminates at an inner end underneath the drain opening. The linkage is so configured that when the plunger is moved by the solenoid from a first position to a second position, the inner end of the linkage will engage the stopper and raise it with respect to the drain opening to permit fluid in the bathtub to flow by gravity through the drain opening into the drain pipe. When the plunger moves to a second position, the stopper drops to its original position by gravity and closes the drain opening.

DESCRIPTION OF THE PREFERRED EMBODIMENT

Figure 1:
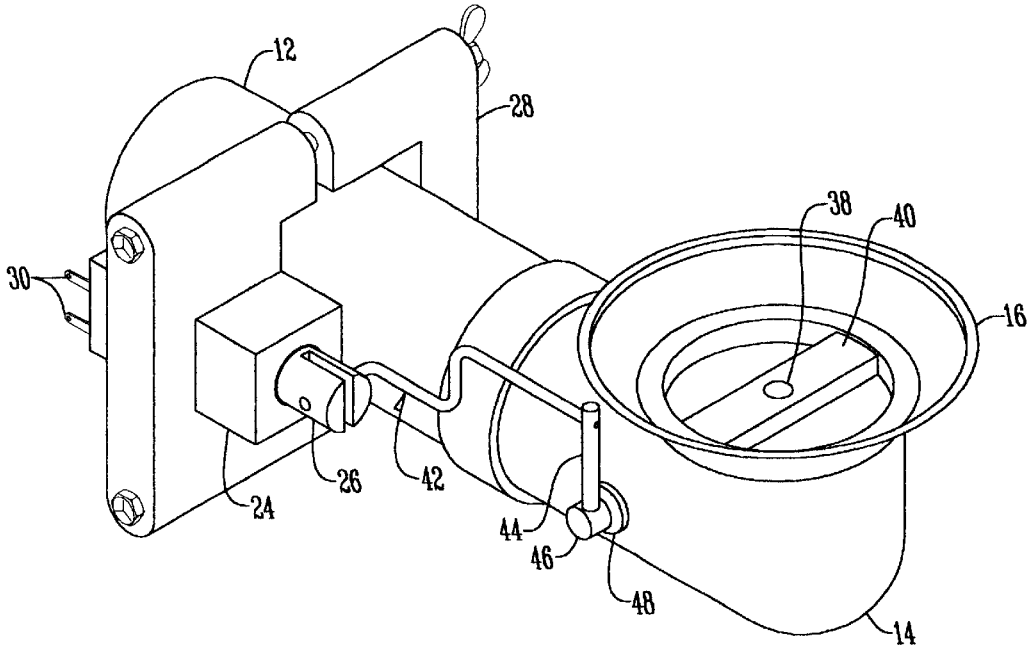
FIG. 1 is a perspective view of the device of this invention mounted on a bathtub drain wherein the drain stopper has been removed.

A bathtub drain assembly 10 has a horizontal pipe portion 12 which terminates in an elbow 14 wherein the upper horizontal rim of the elbow is conventionally affixed to a drain closure fitting 16 which surrounds a drain opening 18 in the bottom 20 of a conventional bathtub 22.

An electrical solenoid 24 having a conventional plunger 26 is secured to pipe 12 by clamp 28. Electrical leads 30 extend from the solenoid 24 and are connected to a source of electrical energy and a remote switch (not shown).

Figure 2:
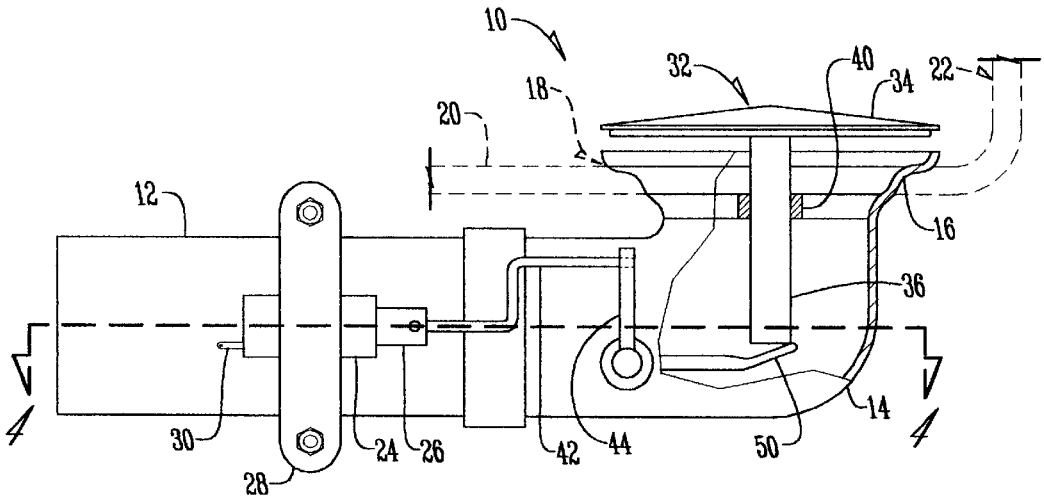
FIG. 2 is a side elevational view of a drain pipe located below the drain opening of a bathtub, with a portion of the linkage of this invention shown in a partial sectional portion of FIG. 2 in a configuration lifting the drain stopper to an open position.
Figure 3:
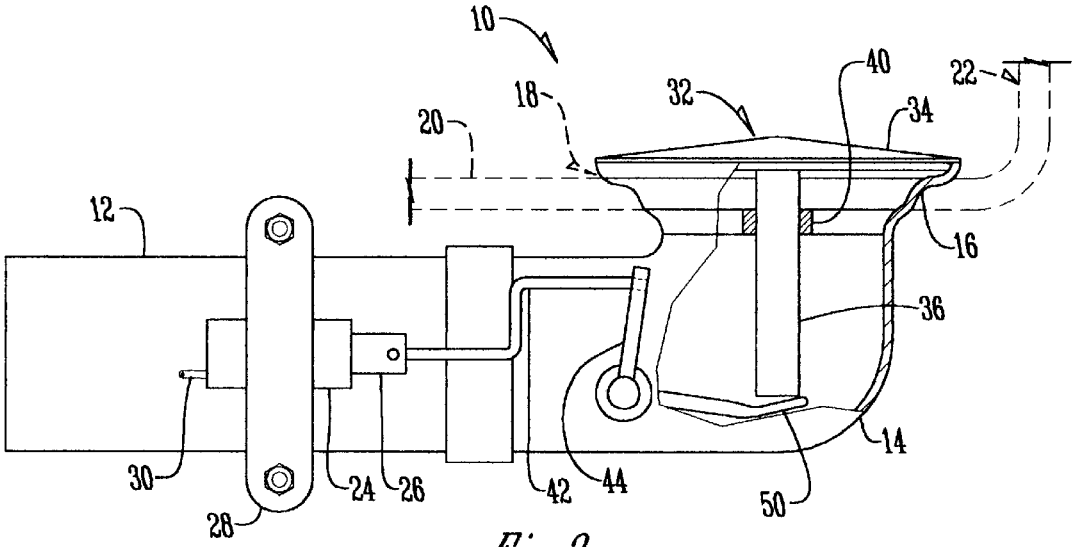
FIG. 3 is a view similar to that of FIG. 2 but shows the linkage in a lowered position out of engagement with the drain stopper wherein the drain stopper has moved to a closed condition.
Figure 4:
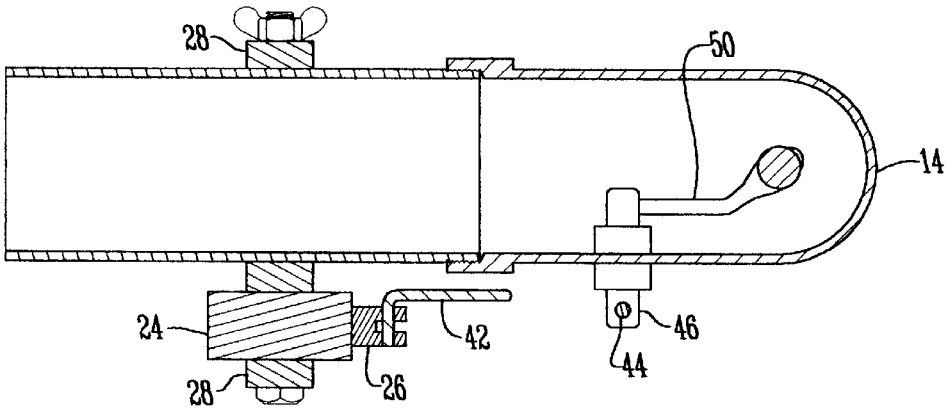
FIG. 4 is a horizontal sectional view of FIG. 2 taken on line 4—4 of FIG. 2.

With reference to FIG. 2, a conventional drain stopper 32 includes a cover 34 which is adapted to engage and extend over drain opening 18 when in its lowered position (FIG. 3). Stopper 32 conventionally has a stem 36 extending vertically downwardly therefrom through hole 38 (FIG. 1) in bar 40 which extends horizontally across the drain closure fitting 16.

Figure 5:
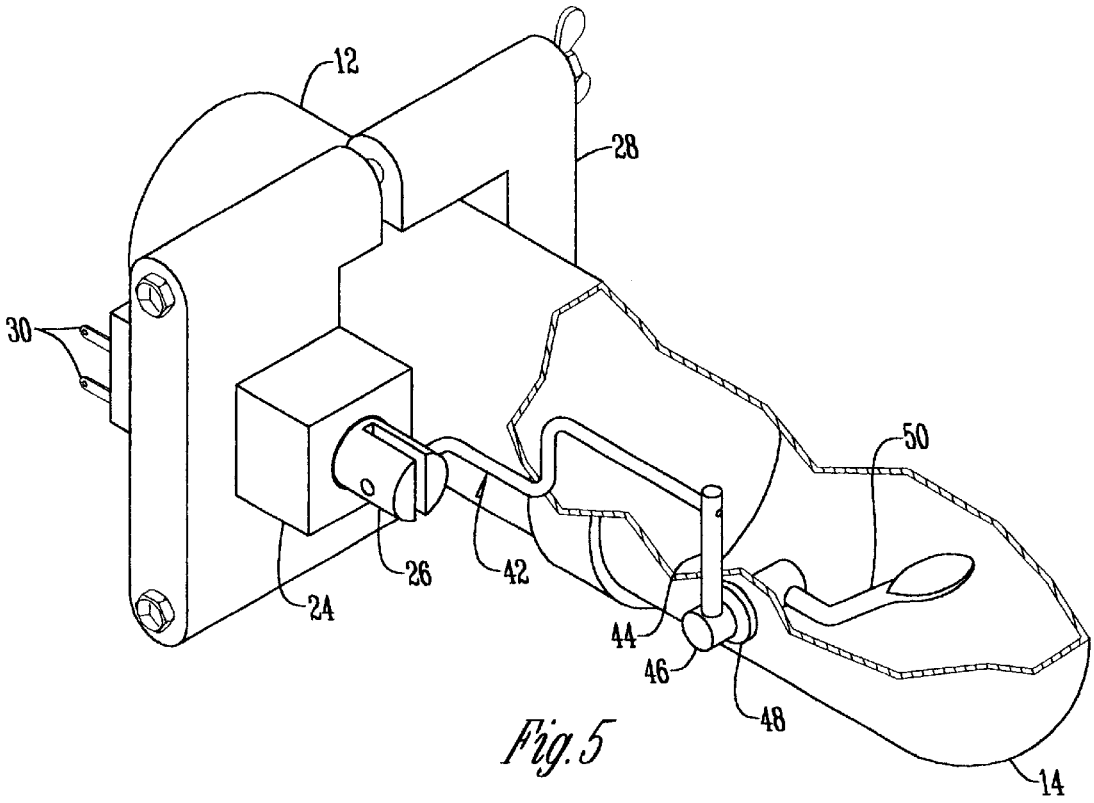
FIG. 5 is a partial perspective view similar to that of FIG. 1 but showing the drain pipe broken away and reflecting the position of the linkage secured to the solenoid.

Linkage 42 has one end secured to the plunger 26 of solenoid 24 (FIGS. 1 and 5) with the other end pivotally connected to upstanding lever 44. The lower end of lever 44 is rigidly affixed to an outer end of crankshaft 46 which extends horizontally through bearing 48 in elbow 14 into the interior of the elbow, and below the drain opening 18. A linkage arm 50 is rigidly secured to the inner end of crankshaft 46 and is adapted to move between a lower position (FIG. 3) to an upper position (FIG. 2) when the plunger 26 moves outwardly and inwardly, respectively, with respect to the solenoid 24.

In operation, when the solenoid 26 is not electrically energized by the remote switch, the plunger 26 of solenoid 24 will be in an extended position wherein the linkage will cause the lever 44 to be in its tilted position as shown in FIG. 3 wherein the linkage arm 50 on the inner end of crankshaft 46 will cause the linkage arm 50 to be in the position of FIG. 3.

When the operator desires to lift the drain stopper 32 to an open or elevated position of FIG. 2, the solenoid is energized to cause the plunger 26 to retract, which will move the linkage arm 50 to the upper position shown in FIG. 2. When in this position, the linkage arm 50 engages the lower end of stem 36 and pushes the stem upwardly through the hole 38 in bar 40, thus lifting the drain stopper 32 from out of engagement with the drain closure fitting 16. In that condition, the water in the tub will move into the elbow 14 and thence through the pipe portion 12 to the conventional drainage system.

It is therefore seen that this invention can be easily installed, easily and efficiently operated, and is comprised of a relatively few parts wherein it is inexpensive to manufacture. Thus, this invention will achieve at least all of its stated objectives.

I claim:

1. A solenoid activated bathtub drain closure, comprising, a bathtub having a bottom with a drain opening therein, a vertically movable drain stopper mounted over the drain opening, a drain pipe connected to the drain opening and positioned below the drain opening, a solenoid having a movable plunger located outside and secured to the drain pipe, linkage secured to the plunger and extending from the plunger and terminating in an inner end in the drain pipe underneath the drain opening, the linkage being so configured that when the plunger is moved by the solenoid from a first position to a second position, the inner end of the linkage will engage the stopper and raise it with respect to the drain opening to permit fluid in the bathtub to flow by gravity through the drain pipe, and a clamp member securing the solenoid to the drain pipe.

2. The device of claim 1 wherein the stopper has a downwardly extending stem which is engagable with the inner end of the linkage.

3. The device of claim 1 wherein the drain pipe includes a horizontal portion to which the solenoid is secured and an elbow portion that extends to the drain opening.

4. The device of claim 1 wherein the plunger moves from the second position to the first position, the stopper is free to move by gravity to close the drain opening.

* * * * *